US007792478B2

(12) United States Patent
Kagawa

(10) Patent No.: US 7,792,478 B2
(45) Date of Patent: Sep. 7, 2010

(54) CLEANING DEVICE FOR IMAGE FORMING APPARATUS

(75) Inventor: Tsuyoshi Kagawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 49 days.

(21) Appl. No.: 12/024,348

(22) Filed: Feb. 1, 2008

(65) Prior Publication Data

US 2008/0187377 A1 Aug. 7, 2008

(30) Foreign Application Priority Data

Feb. 2, 2007 (JP) ..... 2007-024431

(51) Int. Cl.
*G03G 15/08* (2006.01)
*G03G 15/095* (2006.01)

(52) U.S. Cl. ..... 399/358; 399/254; 399/256; 399/264

(58) Field of Classification Search ..... 399/34, 399/35, 71, 98, 99, 123, 149, 245, 249, 254, 399/256, 263, 264, 297, 326, 327, 358, 359, 399/360

See application file for complete search history.

(56) References Cited

U.S. PATENT DOCUMENTS 5,581,337 A * 12/1996 Suzuki ..... 399/263
5,815,784 A * 9/1998 Kasahara et al. ..... 399/358
6,275,674 B1 * 8/2001 Sugimoto ..... 399/254
6,782,234 B2 * 8/2004 Takami ..... 399/359
7,149,455 B2 * 12/2006 Hattori ..... 399/98

FOREIGN PATENT DOCUMENTS

JP 3018713 1/1991
JP 7092875 4/1995

* cited by examiner

*Primary Examiner*—David M Gray
*Assistant Examiner*—Francis Gray
(74) *Attorney, Agent, or Firm*—Canon U.S.A., Inc., IP Division

(57) ABSTRACT

A cleaning device includes a cleaning unit configured to remove toner on an image bearing member, a container adapted to contain the removed toner that is recovered, a screw configured to convey the removed toner toward the container, a spherical moving member configured to be moved by the rotation of the screw in the direction of the rotation axis of the screw, and a driving unit configured to rotate the screw in a first direction for conveying the moving member toward the container and in a second direction opposite from the first direction for conveying the moving member.

5 Claims, 13 Drawing Sheets

CLEANING DEVICE FOR IMAGE FORMING APPARATUS

BACKGROUND OF THE INVENTION

1. Field of the Invention

The present invention relates to a cleaning device for an image forming apparatus such as a copying machine, a laser printer, or a facsimile, and more specifically, it relates to a toner recovering device that conveys and recovers toner.

2. Description of the Related Art

Image forming apparatuses are provided with a toner recovering device that removes and recovers residual toner on an image bearing member such as a photosensitive member or an intermediate transfer member. This toner recovering device includes a cleaning member that removes residual toner on the image bearing member, a recovered toner container that contains residual toner removed by the cleaning member, and a conveying unit that conveys residual toner to the recovered toner container. The conveying unit conveys recovered toner with a screw having a spiral shape, along the conveying path to the recovered toner container.

However, the flowability of toner conveyed by the conveying screw of the conveying unit decreases significantly due to commingling of paper debris or depending on temperature and humidity. If the flowability of toner being conveyed is low, toner is deposited and agglomerated in the vicinity of the screw, and a toner clog occurs in the conveying path. In addition, if the flowability of toner being conveyed is low, the recovered toner is attached to the surface of the spiral blade of the conveying screw. This attachment decreases the conveying capacity of the conveying screw and causes a toner clog in the recovered toner conveying mechanism. If a toner clog occurs in the conveying path, the load on the drive system that drives the conveying unit increases, and the inside of the apparatus is contaminated.

In order to prevent the deposition of toner, a ball is used as discussed in Japanese Patent Laid-Open No. 7-92875 and Japanese Patent Publication No. 3-18713. Specifically, in order to prevent the deposition of toner in the vicinity of an opening through which toner is sent to a conveying screw, a ball is disposed in the opening.

However, toner can be deposited not only in the opening but also on the conveying screw. Also, in such a case, a toner clog occurs. Particularly in the case of a conveying screw such that the moving distance of toner is large, the deposition of toner is significant. Therefore, it is necessary to prevent toner from being widely deposited on the conveying screw.

SUMMARY OF THE INVENTION

The present invention is directed to a cleaning device that prevents deposition of toner in a conveying path along which toner is conveyed.

In an aspect of the present invention, a cleaning device includes a cleaning unit, a container, a screw, a spherical moving member, and a driving unit. The cleaning unit is configured to remove toner on an image bearing member. Removed toner is recovered into the container. The screw is configured to convey the removed toner toward the container. The moving member is configured to be moved by the rotation of the screw. The driving unit is configured to rotate the screw in a first direction for conveying toner toward the container and in a second direction opposite to the first direction for conveying the moving member.

Further features of the present invention will become apparent from the following description of exemplary embodiments with reference to the attached drawings.

DESCRIPTION OF THE EMBODIMENTS

Embodiments of the present invention will now be described with reference to the drawings.

Figure 1:
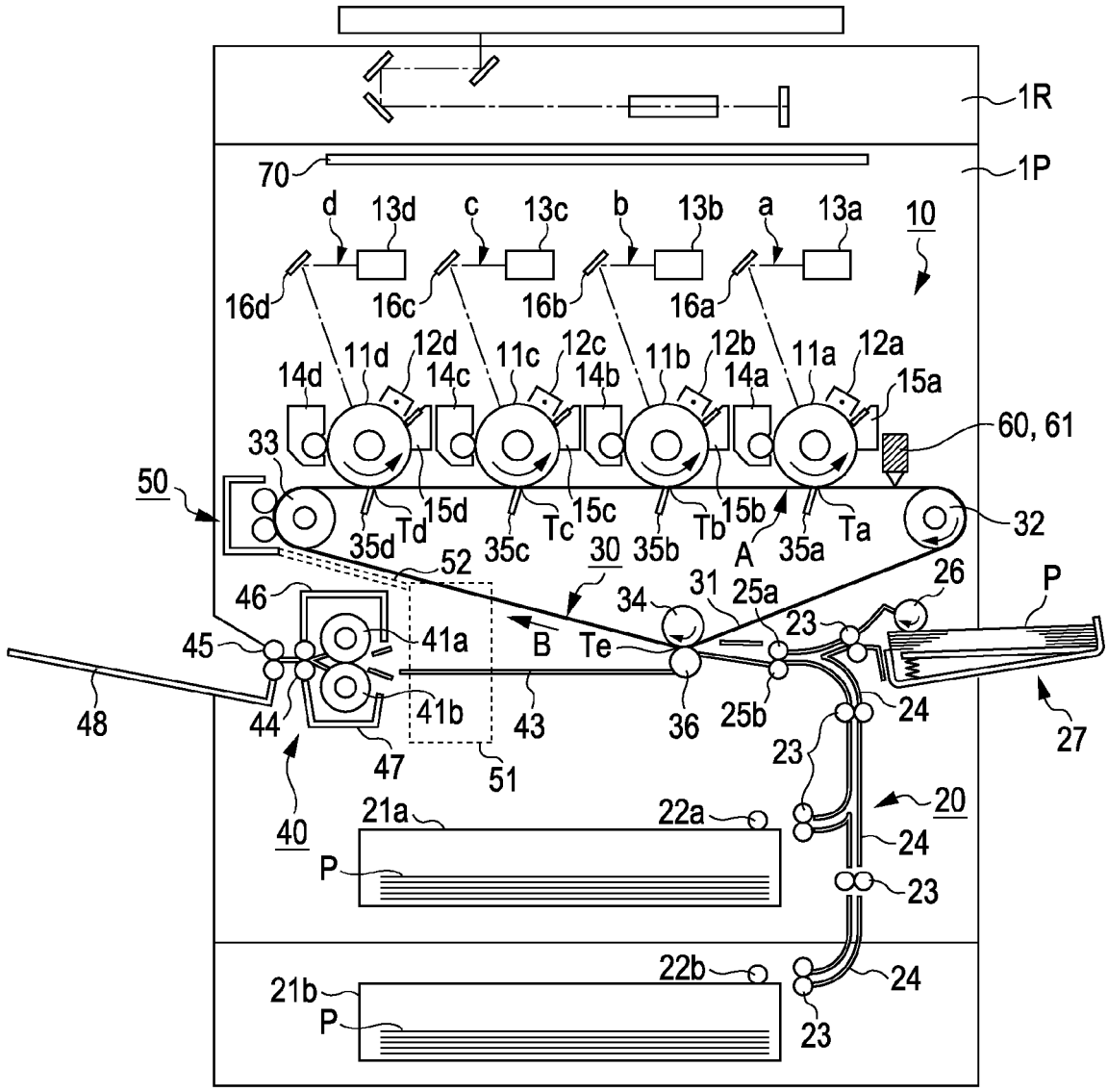
FIG. 1 schematically illustrates the structure of an embodiment.

FIG. 1 shows an example of an image forming apparatus according to the present invention. The image forming apparatus shown in the figure is an intermediate-transfer, full-color laser beam printer having four image forming stations arranged tandemly.

The image forming apparatus shown in the figure includes a printer portion 1P and a reader portion 1R.

The printer portion 1P is composed mainly of an image forming unit 10, a paper feeding unit 20, an intermediate transfer unit 30, a fixing unit 40, and a control unit (not shown). The image forming unit 10 includes four image forming stations a, b, c, and d having the same structure.

The image forming unit 10 has the following structure. Photosensitive drums (photosensitive members) 11*a*, 11*b*, 11*c*, and 11*d* that serve as image bearing members are supported rotatably around their centers and are rotary-driven in the direction of arrows. Around the curved surface of each of the photosensitive drums 11*a* to 11*d* are disposed a primary charger (12*a*, 12*b*, 12*c*, 12*d*) and a developer (14*a*, 14*b*, 14*c*, 14*d*). Exposure units 13*a*, 13*b*, 13*c*, and 13*d* each form an electrostatic latent image. Folding mirrors 16*a*, 16*b*, 16*c*, and 16*d* each direct a laser from a corresponding exposure unit to a corresponding photosensitive drum. The primary chargers 12*a* to 12*d* uniformly charge the surfaces of the photosensitive drums 11*a* to 11*d* to a predetermined polarity and at a predetermined potential. The exposure units 13*a* to 13*d* each emit a laser beam modulated according to an image signal. The charged surfaces of the photosensitive drums are exposed by the lasers via the folding mirrors 16*a* to 16*d*. In this way, an electrostatic latent image is formed on the surface of each photosensitive drum. The developers 14*a* to 14*d* contain yellow, cyan, magenta, and black toners, respectively. The developers attach toner to the electrostatic latent images to develop the latent images into toner images. These toner images are transferred onto an intermediate transfer belt (endless belt) 31 that serves as an intermediate transfer member, in primary transfer regions Ta, Tb, Tc, and Td. A cleaning device (15*a*, 15*b*, 15*c*, 15*d*) is disposed downstream of each of the image transfer regions Ta to Td in the rotation direction of each of the photosensitive drums 11*a* to 11*d*. These cleaning devices scrape off residual toner that is not transferred onto the intermediate transfer belt 31 and that remains on the photosensitive drums 11*a* to 11*d*, to clean the drum surfaces. Each cleaning device is provided with a cleaning blade that removes toner on each photosensitive drum. Through the above-described image forming process, toner images in each color are formed sequentially. Of the primary transfer regions Ta to Td, the most downstream primary transfer region Ta in the moving direction of the intermediate transfer belt 31 is referred to as the most downstream transfer region.

The paper feeding unit 20 has paper cassettes 21*a* and 21*b* each containing recording materials P, and a manual feed tray 27. Pickup rollers 22*a*, 22*b*, and 26 send out recording materials P one at a time. Recording materials P sent out by the pickup rollers are conveyed to registration rollers 25*a* and 25*b* by paper feeding roller pairs 23 and paper feeding guides 24. A recording material P is sent out to a secondary transfer region Te by the registration rollers 25*a* and 25*b* in timed relationship with the image formation in the image forming stations a, b, c, and d.

The intermediate transfer unit 30 includes an intermediate transfer belt 31 that serves as an intermediate transfer member. The intermediate transfer belt 31 is stretched around a driving roller 33, a driven roller 32, and a secondary transfer opposing roller 34. The driving roller 33 drives the intermediate transfer belt 31. The driven roller 32 is driven and rotated by the rotation of the intermediate transfer belt 31. The secondary transfer opposing roller 34 is opposed to the secondary transfer region Te. A primary transfer plane A is formed between the driving roller 33 and the driven roller 32. The driving roller 33 is a metal roller coated with a several millimeters thick coating of (urethane or chloroprene) rubber to prevent belt slippage. The driving roller 33 is rotary-driven by a below-described driving motor. Primary transfer chargers 35*a*, 35*b*, 35*c*, and 35*d* are disposed on the inner surface of the intermediate transfer belt 31 in the primary transfer regions Ta to Td where the photosensitive drums 11*a* to 11*d* are opposed to the intermediate transfer belt 31. A secondary transfer roller 36 is opposed to the secondary transfer opposing roller 34. The nip between the secondary transfer roller 36 and the intermediate transfer belt 31 forms the secondary transfer region Te. The secondary transfer roller 36 is pressed against the intermediate transfer belt 31 at an appropriate pressure. A cleaning device 50 that cleans the image forming surface of the intermediate transfer belt 31 is provided downstream to the secondary transfer region Te in the moving direction of the intermediate transfer belt 31 (the direction of arrow B). This cleaning device 50 will hereinafter be described. From this cleaning device 50 through a conveying path 52, toner is recovered into a recovered toner container 51 provided on the back of the image forming apparatus.

The fixing unit 40 includes a fixing roller 46 having a heat source 41*a* such as a halogen heater therein, and a pressing roller 47 having a heat source 41*b* therein and being in contact with the fixing roller 46. A guide 43 guides a recording material P to the nip portion between the fixing roller 46 and the pressing roller 47. A recording material P ejected from the nip portion is ejected out of the main body of the image forming apparatus by an inner eject roller pair 44 and an outer eject roller pair 45. The ejected recording material P is received by an output tray 48.

The control unit includes a control board for controlling the operation of a mechanism in each of the above-described units, and a motor drive board (not shown).

Next, the operation of the image forming apparatus will be described.

Upon input of an image formation signal, recording materials P are sent out one at a time from the paper cassette 21*a* by the pickup roller 22*a*. The recording material P is then conveyed to the registration rollers 25*a* and 25*b* by the feed roller pair 23, being guided by the paper feeding guides 24. At this time, the registration rollers are not rotating, and the leading edge of the recording material P hits against the nip portion. Thereafter, the registration rollers 25*a* and 25*b* start to rotate in timed relationship with the start of the image formation in the image forming stations. The rotation timing is set so that the recording material P can be registered with the toner images primary-transferred onto the intermediate transfer belt 31 from the image forming stations, in the secondary transfer region Te.

In the image forming unit, upon generation of an image formation signal, a toner image is formed on the photosensitive drum 11*d* of the most upstream image forming station d in the moving direction of the intermediate transfer belt 31. This toner image is primary-transferred to the intermediate transfer belt 31 in the primary transfer region Td by the primary transfer charger 35*d* to which a high voltage is applied. The primary-transferred toner image is conveyed to the next primary transfer region Tc. There is performed image formation with a delay of the length of time the toner image is conveyed from the image forming station d to the image forming station c. The next toner image is registered with and transferred onto the toner image on the intermediate transfer belt 31. Thereafter the same process is repeated, and finally, toner images in four colors are primary-transferred onto the intermediate transfer belt 31 in a superposed manner.

Thereafter, with the rotation of the intermediate transfer belt 31 in the direction of arrow B, the recording material P enters the secondary transfer region Te and comes into contact with the intermediate transfer belt 31. A high voltage is applied to the secondary transfer roller 36 in timed relationship with the passage of the recording material P. The toner images in four colors on the intermediate transfer belt 31 are secondary-transferred onto the surface of the recording material P at once. Thereafter, the recording material P is accurately guided to the nip portion between the fixing roller 46 and the pressing roller 47 by the guide 43. The recording material P is heated and pressed by these rollers, and the toner images are fixed on the surface the recording material P. Thereafter, the recording material P is ejected onto the output tray 48 by the inner and outer eject roller pairs 44 and 45.

Figure 2:
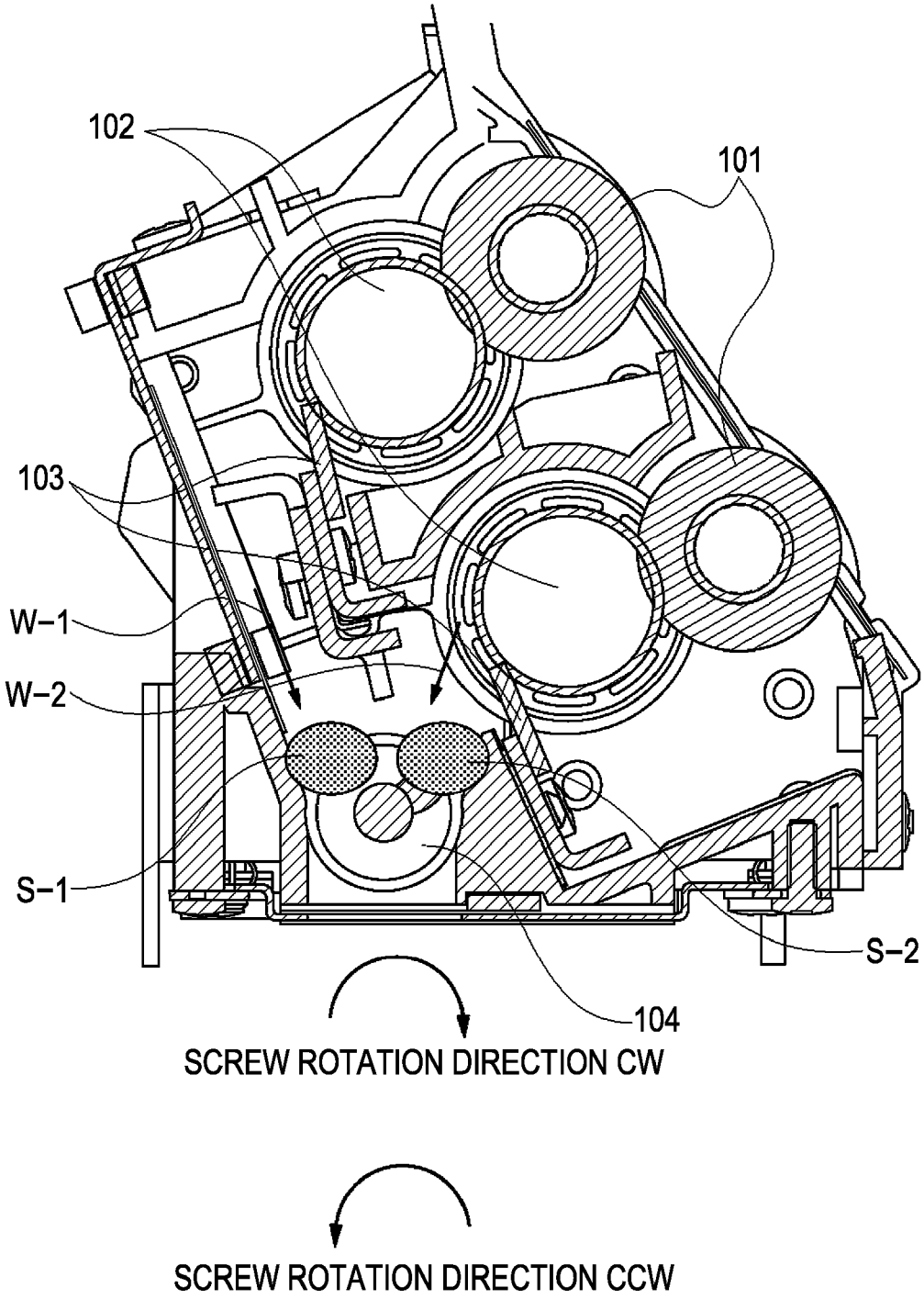
FIG. 2 schematically illustrates deposition and attachment of waste toner in the embodiment.

Next, deposition and attachment of recovered toner in an embodiment of the present invention will be briefly described with reference to FIG. 2. FIG. 2 illustrates the cleaning device 50 in detail. Toner remaining on the intermediate transfer belt is recovered by recovering brushes 101. The recovered toner is recovered by recovering rollers 102. The recovered toner is dropped onto a conveying screw 104 by recovering blades 103. Due to the upper falling path W-1 and the lower falling path W-2 of the recovered toner, the recovered toner is deposited in the upper left portion S-1 and the upper right portion S-2 of the screw. In addition, the recovered toner is attached and deposited on the screw surface. Although the screw rotation directions CW and CCW are shown in FIG. 2, agitating balls that serve as spherical moving members can move in the opposite direction from that in this embodiment, depending on the shape of the screw and the configuration of the residual toner recovering device. This embodiment has a driving unit, such as a motor, capable of switching the rotation direction of the screw between CW and CCW. An opening 53 in FIG. 3A communicates with the conveying path 52. Normally, the screw rotates in the direction CW and the toner is conveyed by the screw toward the opening 53 in the center. A motor M in FIG. 3A drives the screw. A CPU 200 in FIG. 3A serves as a control unit that controls the drive of the motor M. The CPU 200 controls the stop, start, and rotation direction of the motor M.

Figure 3A:
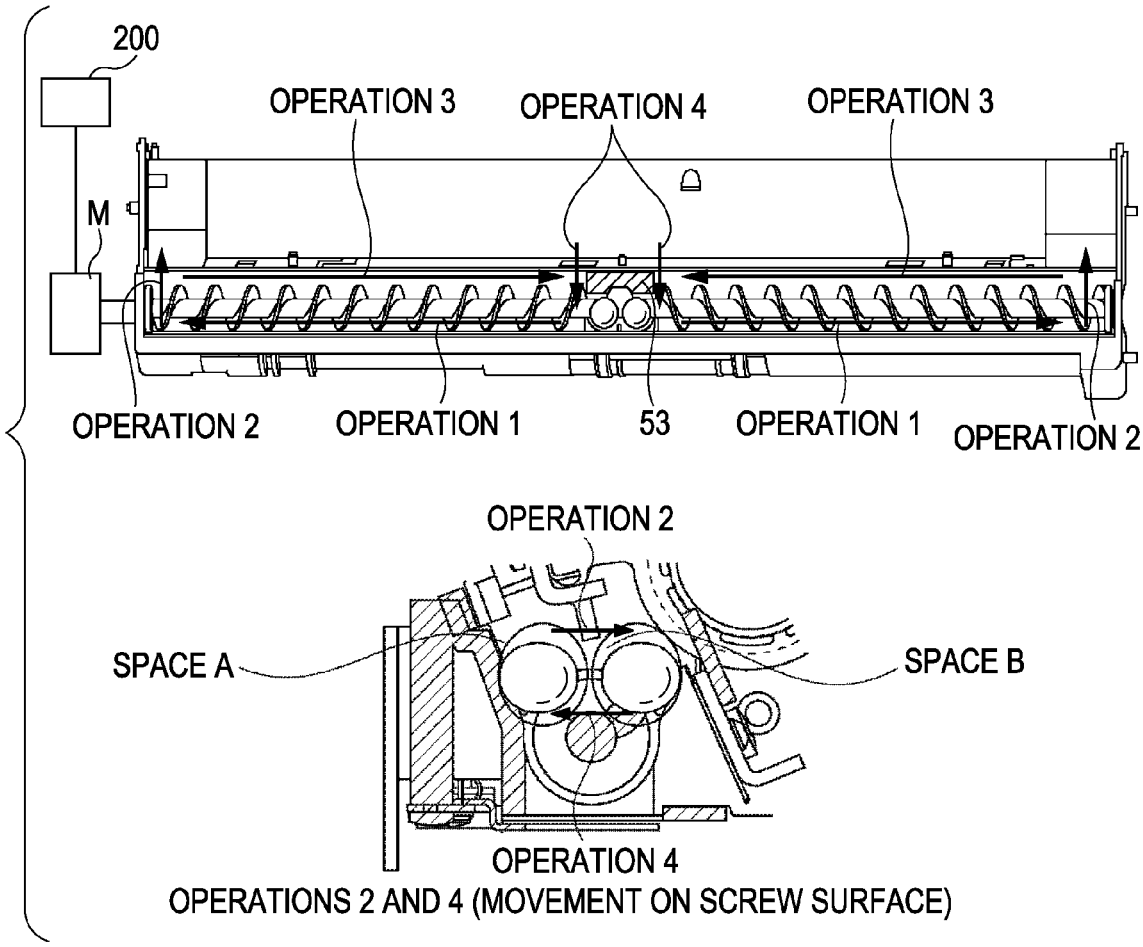
FIG. 3A schematically illustrates operations of agitating balls in the embodiment.

The operations of the agitating balls in this embodiment will be described with reference to FIG. 3A. Due to the spiral shape of the screw, by switching the rotation direction of the screw, the agitating balls are conveyed in the same direction as the direction in which toner is conveyed toward the recovered toner container. When the rotation direction is CW, the screw conveys toner toward the recovered toner container. As a result, the agitating balls move along the rotation axis in the same direction as the direction in which toner is conveyed. Since the screw rotates normally in the direction CW, the agitating balls are located in the center. In FIG. 3A, there are two recovered-toner conveying paths, and therefore two agitating balls are disposed. However, the present invention can be applied to the case of a single conveying path. After being conveyed from the center to each end of the screw in Operation 1, the agitating balls move from Space A (first region) to Space B (second region) in FIG. 2 due to the screw shape (Operation 2). At this time, the rotation direction of the screw is CCW. Next, by rotating the screw in the opposite direction (CW), the agitating balls are conveyed from each end to the center (Operation 3). After being conveyed to the center in Operation 3, the agitating balls move from Space B to Space A in FIG. 2 due to the screw shape (Operation 4).

Figure 3B:
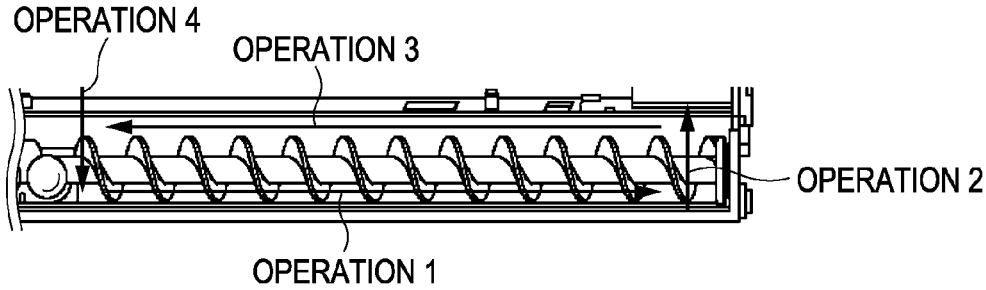
FIG. 3B illustrates a case of a single waste-toner conveying path.

This series of operations can cause the agitating balls to operate throughout the screw. This can prevent recovered toner from being attached to the entire surface of the screw and from being deposited in Space A and Space B. The series of operations do not always have to start with Operation 1 and can start with any one of Operations 1, 2, 3, and 4. They can be performed in reverse order depending on the configuration of the toner recovering device. The series of operations do not always have to end with Operation 4 and can end with any one of Operations 1, 2, 3, and 4. Also in the case where recovered toner is conveyed along a single recovered-toner conveying path (see FIG. 3B), Operations 1 to 4 can be performed. Also in this case, the series of operations do not always have to start with Operation 1 and can start with any one of Operations 2, 3, and 4. The series of operations do not always have to end with Operation 4 and can end with any one of Operations 1, 2, 3, and 4.

The operations will be specifically described. During the image forming operation, since recovered toner is conveyed toward the recovered toner container, the screw rotates in the direction CW. As a result, during the image formation, the agitating balls are often located in the center. Therefore, during the post-rotation after the image formation is completed, the screw is rotated in the direction CCW opposite to the direction CW so that the agitating balls perform Operation 1. The screw is rotated in the direction CCW for a predetermined time. As a result, the agitating balls reach each end. In this embodiment, after the lapse of the predetermined time, the CCW rotation of the screw stops. Thereafter, upon input of another image formation signal, the screw rotates in the direction in which toner is conveyed toward the recovered toner container. Therefore, the agitating balls move from each end to the center.

In this embodiment, Operations 1 and 2 are performed during the post-rotation after the image formation, and Operations 3 and 4 are performed during the pre-rotation before the image formation of the next job or during the image formation of the next job. Alternatively, the series of operations from Operation 1 to Operation 4 may be performed after the image formation.

Next, the shape of a separating member will be described with reference to FIG. 4. A separating plate 401 is disposed over the screw so that the space over the screw is separated into two (Space A and Space B). The agitating balls can exist in Space A and Space B, respectively. The distance H1 between the lower end of the separating plate and the depressed portion of the screw (the shaft portion of the screw) is smaller than the diameter of the agitating balls. Although spherical agitating balls are used in this embodiment, oval agitating balls may also be used. In this case, the above distance is smaller than the short axis.

Figure 4:
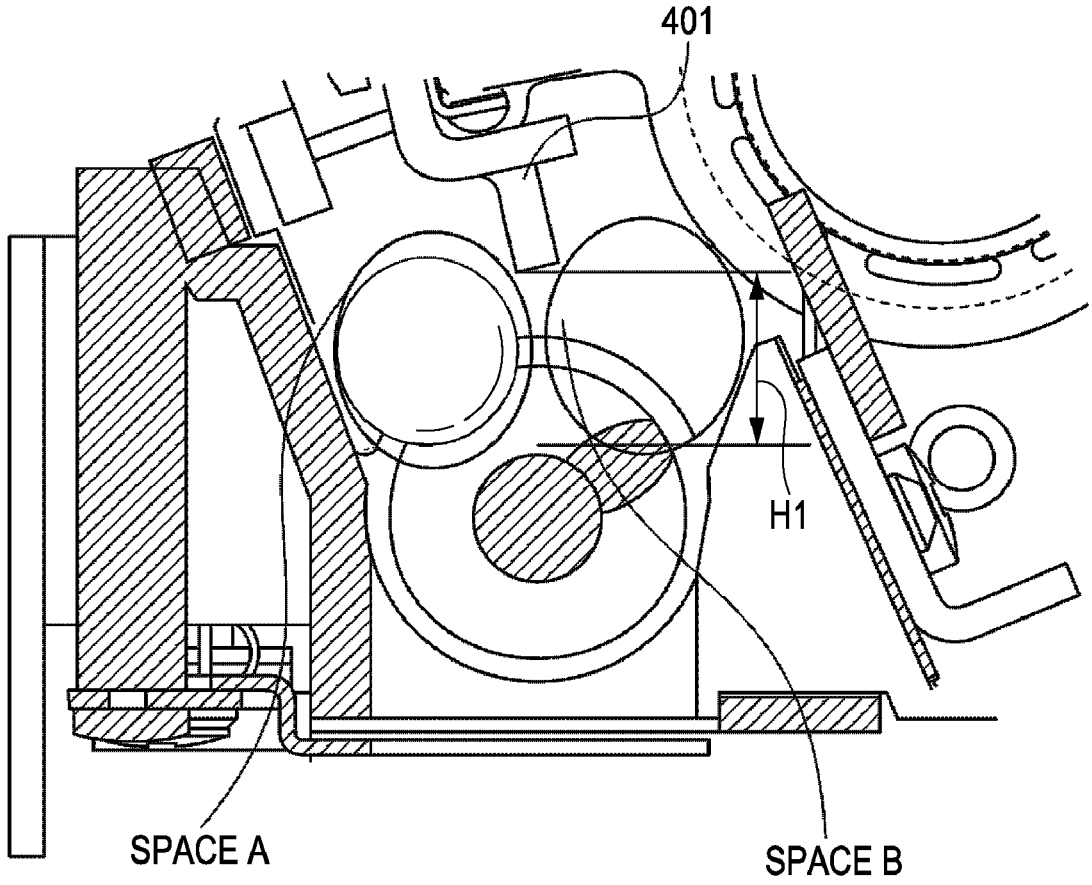
FIG. 4 is a sectional view illustrating the shape of a separator in the embodiment.

When the agitating balls move in only one of the spaces (Operations 1 and 3 in FIG. 3A), the agitating balls are prevented from moving between the spaces by the separating plate whose lower end is lower than the tops of the agitating balls (see FIG. 4). When the agitating balls break deposited toner in Space A or Space B, the agitating balls can be prevented from being caused to move between Space A and Space B, in regions other than predetermined regions, by the agglomerating property or flowability of toner.

Figure 5A:
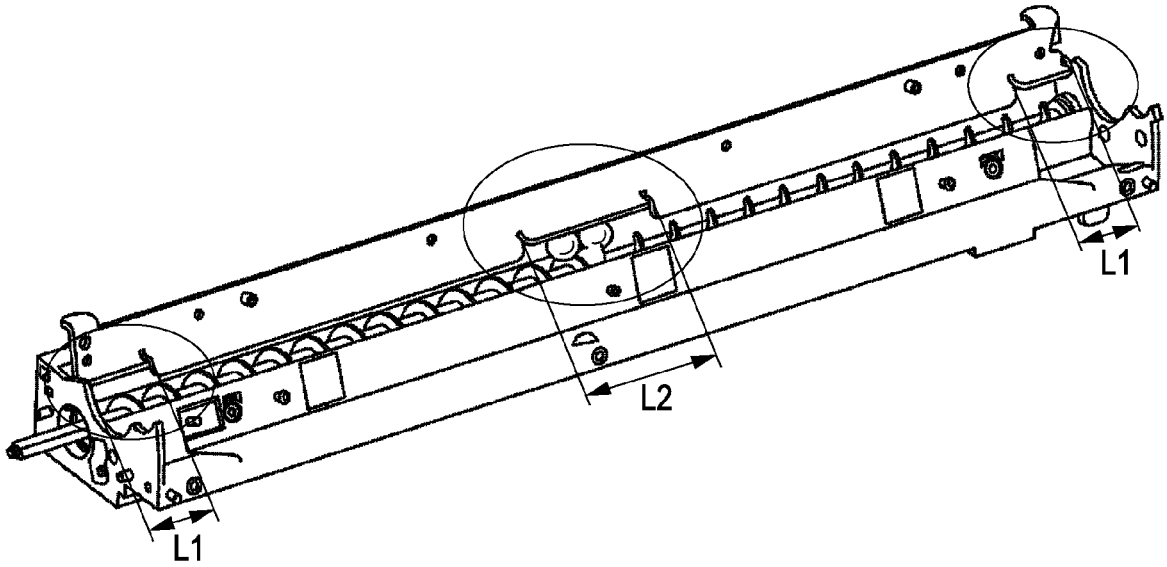
FIG. 5A illustrates the shape of the separator in the embodiment.
Figure 5B:
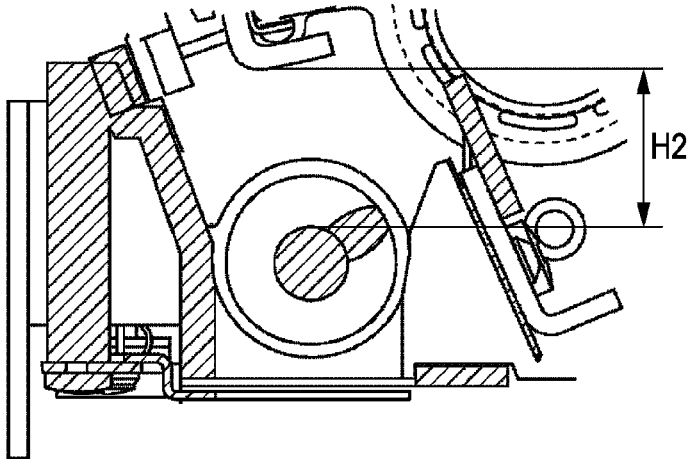
FIG. 5B is a sectional view illustrating the shape of the separator in the embodiment.

Next, movement of the agitating balls between the two spaces will be described with reference to FIG. 5A. Operation 2 in FIG. 3A is movement from Space A to Space B (through each opening L1 in FIG. 5A). Operation 4 in FIG. 3A is movement from Space B to Space A (through opening L2 in FIG. 5A). These operations are performed in regions at each end of the screw. In these regions, the maximum distance between the lower end of the separating plate and the screw is larger than the diameter of the agitating balls (see FIG. 5B). The maximum distance is the distance H2 between the depressed portion (the shaft portion of the screw) and the lower end of the separating member. The rotation of the screw causes the agitating balls to move in a direction perpendicular to the axial direction of the screw.

Figure 6:
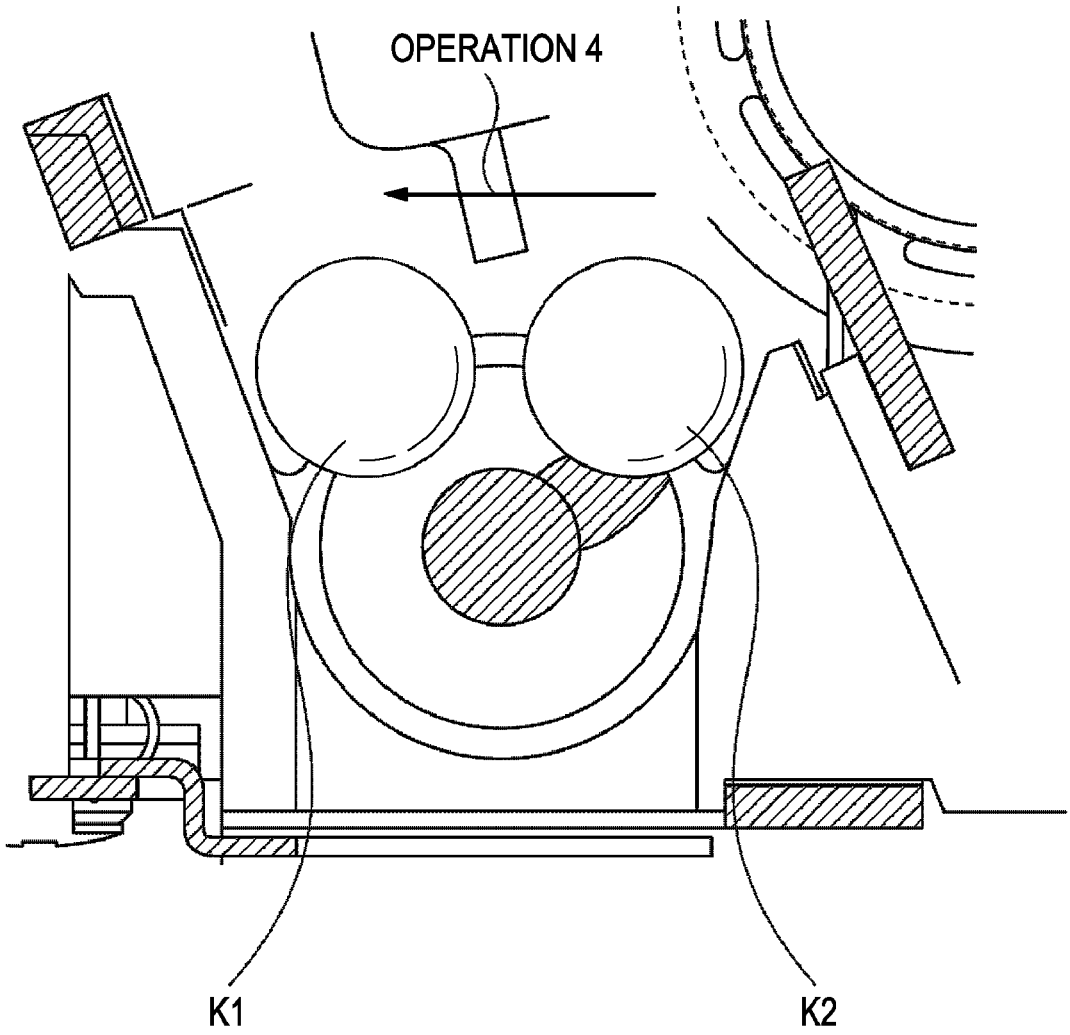
FIGS. 6 and 7 illustrate operations of the agitating balls in the center of a screw in the embodiment.
Figure 7:
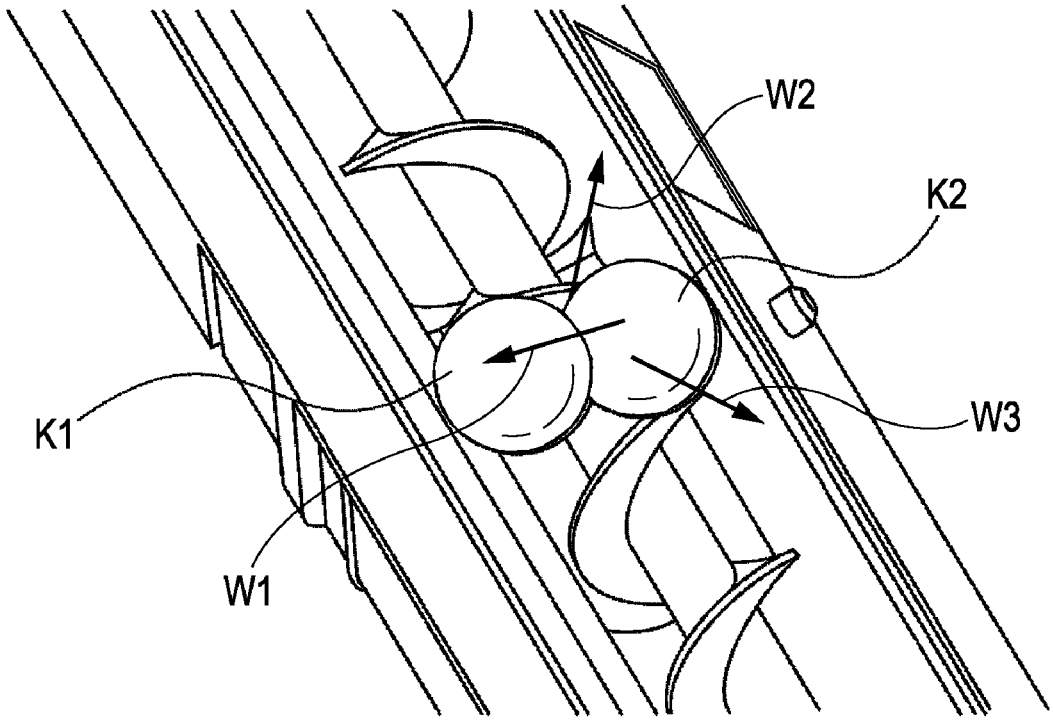
Figure 8A:
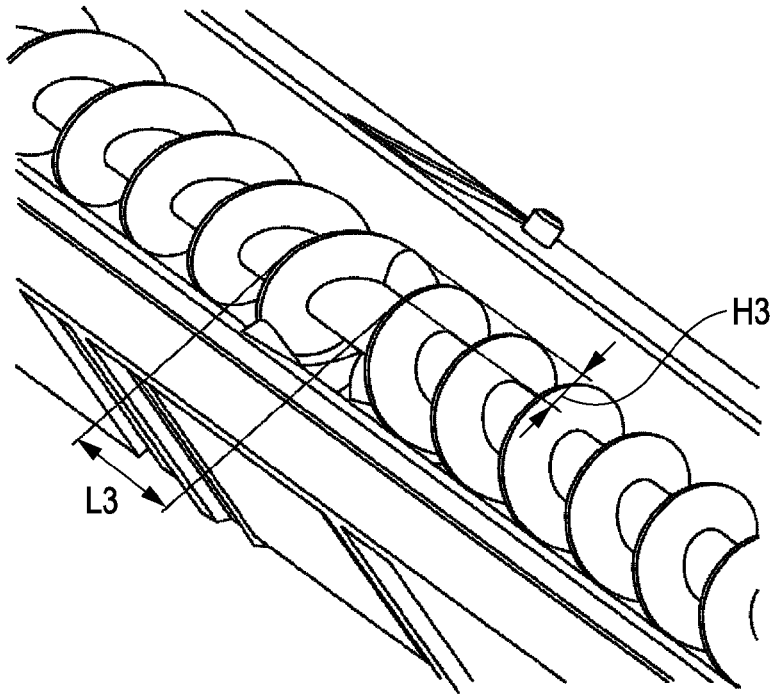
FIG. 8A illustrates a paddle shape of the screw in the embodiment.
Figure 8B:
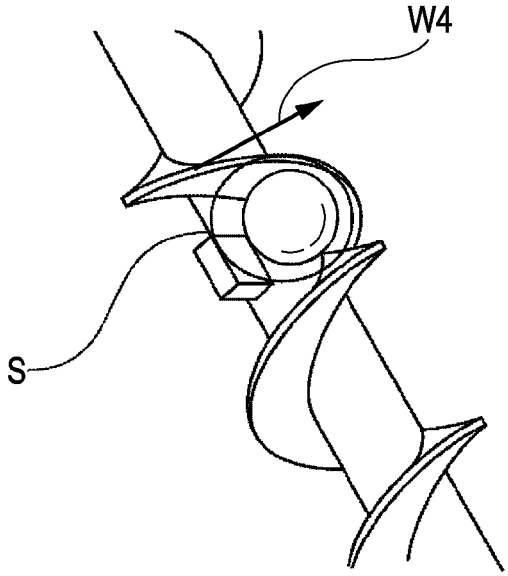
FIGS. 8B and 8C illustrate examples of the shape of the screw.
Figure 8C:
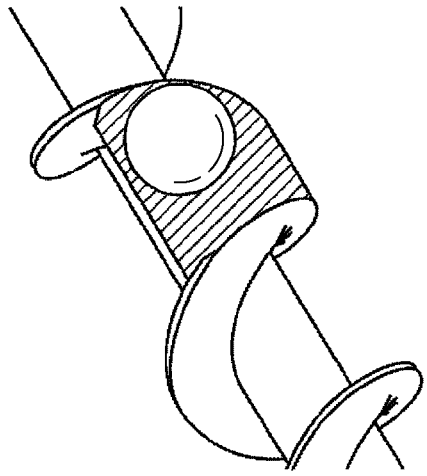

Next, Operation 4 in the case where there are two recovered-toner conveying paths will be described. In this embodiment, two screws that convey toner in the different directions are integrated. Therefore, this embodiment has a junction where different screws meet. Since there are two recovered-toner conveying paths for one screw, two agitating balls are disposed in each path. Since two agitating balls are disposed, the two agitating balls have to move from Space B to Space A (see FIG. 6) during Operation 4 in FIG. 3A. However, as shown in FIG. 7, when one agitating ball (K1 in FIG. 7) is in Space A, it is possible that the other agitating ball (K2 in FIG. 7) attempts to move from Space B to Space A (in the direction W1 in FIG. 7). In this case, due to the existence of the agitating ball K1, the agitating ball K2 cannot move to Space A and is caused to operate in the direction W2 or W3 in Space B in FIG. 7. In order to prevent this, it is desirable to dispose a paddle shape shown in FIG. 8A for causing the agitating ball to move Space B to Space A. The height (H3 in FIG. 8A) of the paddle is more than 0.25 times of the diameter D of the agitating balls. When the agitating balls are moved from Space B to Space A by the paddle, the distance L3 between the screws should be more than twice the diameter D of the agitating balls. In order for the two agitating balls to perform Operation 4, the width (L2 in FIG. 5A) of the central opening should be more than twice the diameter D of the agitating balls. The two agitating balls may have different diameters. The paddle may also have a shape shown in FIG. 8B. In the case of the shape of FIG. 8B, an agitating ball can be trapped between the paddle shape and the screw shape (S in FIG. 8B). Therefore, when the screw rotates in reverse (CCW), it is possible that the agitating ball does not perform Operation 1 and moves from Space A to Space B (W4 in FIG. 8B). Therefore, the shaded area should be stopped up as shown in FIG. 8C. Alternatively, a mechanism that detects the rotation phase of the screw may be provided so that the screw can start reverse rotation without trapping an agitating ball between the paddle shape and the screw.

Figure 9:
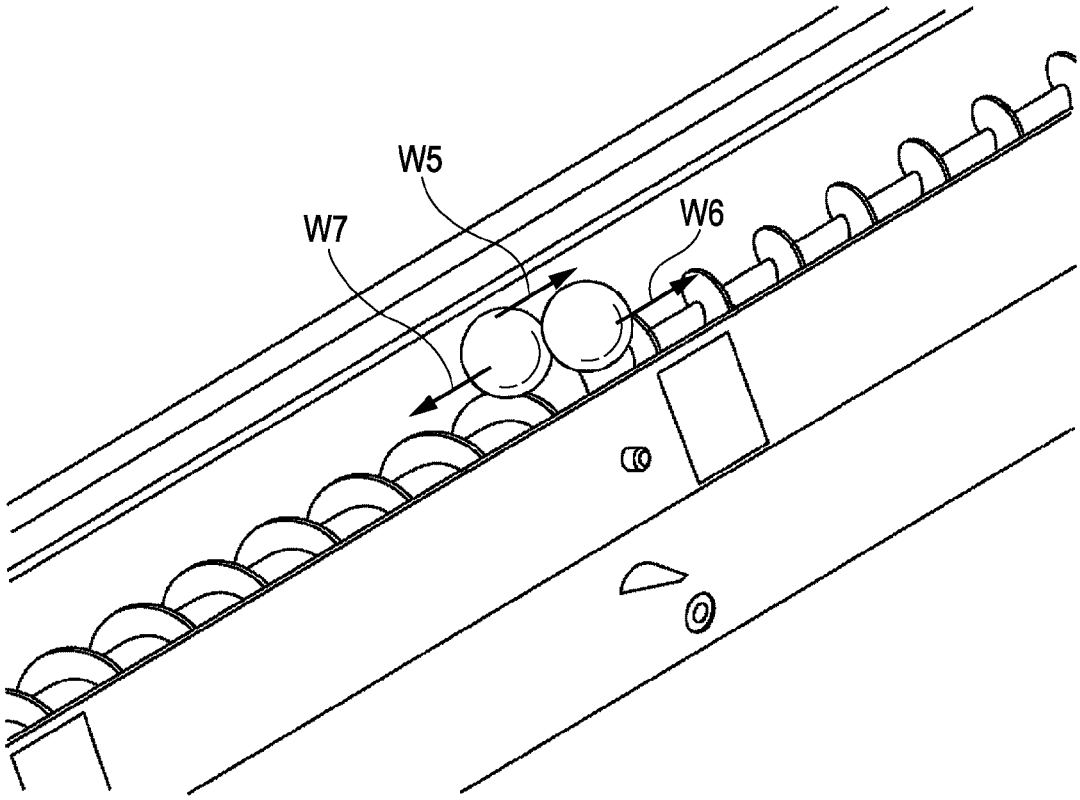
FIG. 9 illustrates operations of the agitating balls in the center of the screw.
Figure 10:
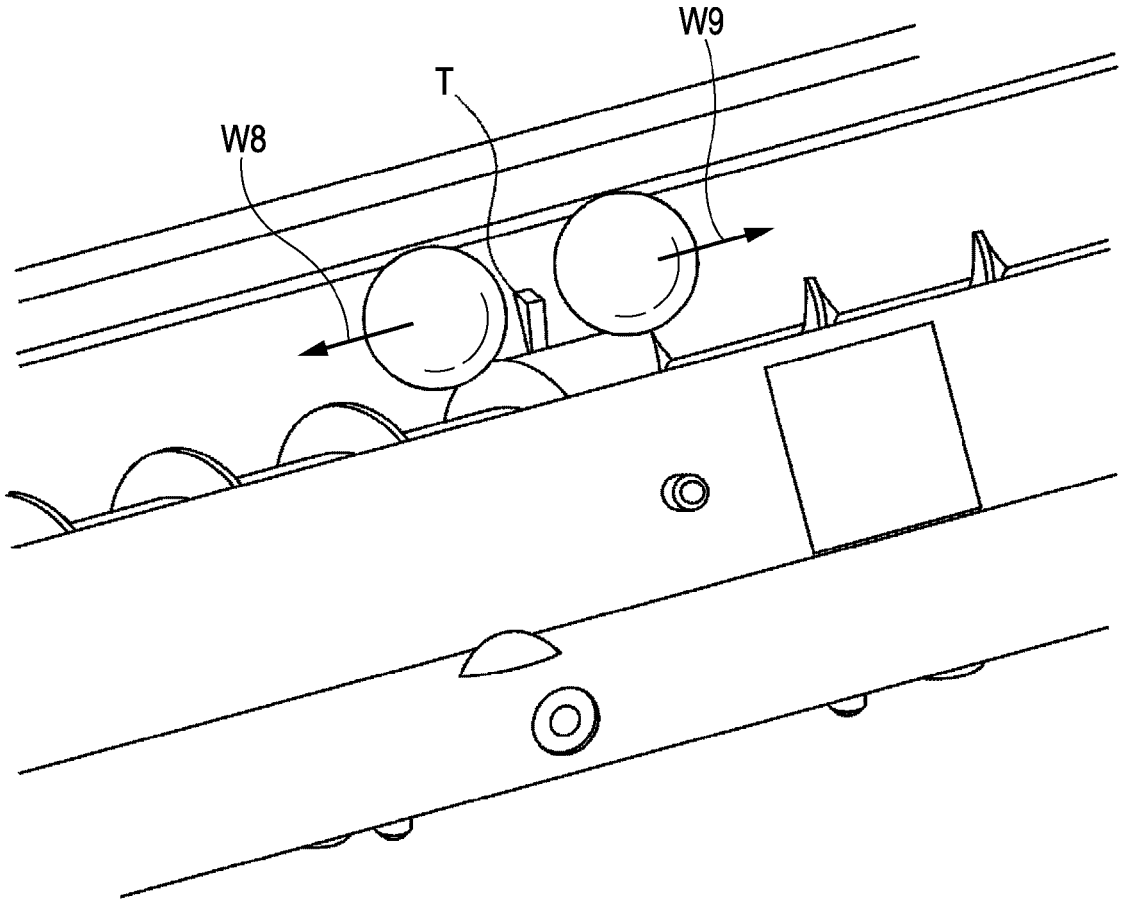
FIG. 10 illustrates a protrusion for ensuring operations of the agitating balls from the center in the embodiment.

Next, the optimum shape for Operation 1 in the case of two agitating balls will be described. Since two agitating balls exist in the center of Space A before Operation 1, the two agitating balls should move in different directions W6 and W7 as shown in FIG. 9 during Operation 1. However, if the left agitating ball moves not in the direction W7 but in the direction W5, the two agitating balls move in the same path and no agitating ball operates in the other path. In order to prevent this, there should be provided a protrusion T as shown in FIG. 10 to prevent the two agitating balls from moving in the same direction and so that they can operate in their respective paths.

Figure 11A:
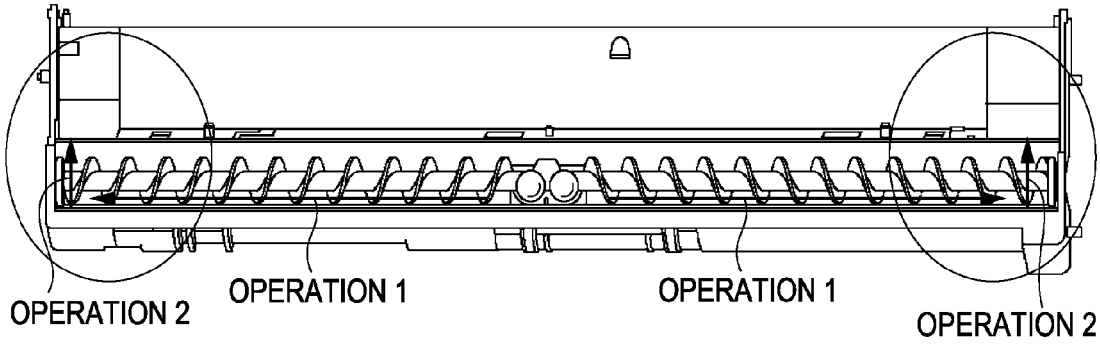
FIG. 11A schematically illustrates operations of the agitating balls in the embodiment.
Figure 11B:
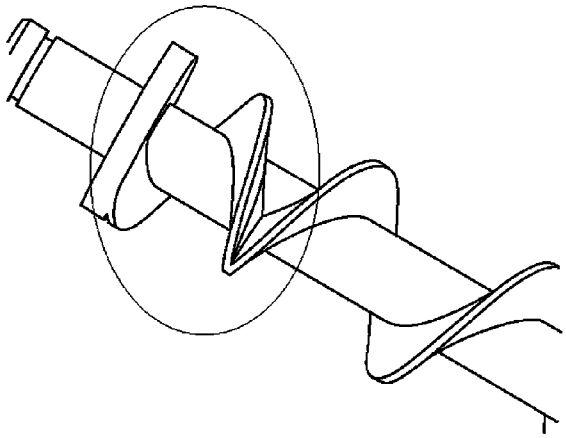
FIGS. 11B and 11C illustrate examples of the shape of the screw.
Figure 11C:
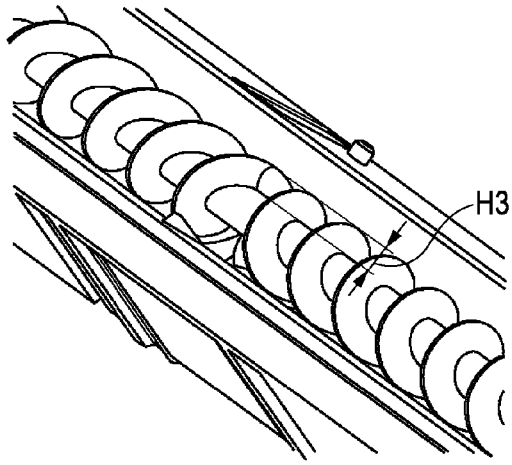

Next, the optimum shape of each end of the screw will be described. During Operation 1, not only the agitating balls but also the recovered toner are conveyed to each end. Therefore, the recovered toner can be deposited at each end. By providing a recovered toner returner (FIG. 11B) at each end of the screw, deposition at each end can be prevented. In addition, a paddle shape (FIG. 11C) may be provided at each end so that the agitating balls can reliably move from Space A to Space B during Operation 2.

Figure 12A:
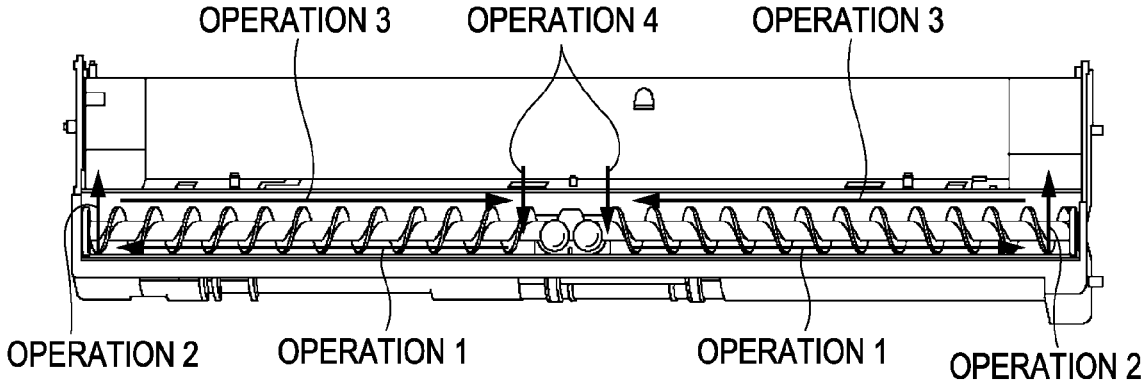
FIGS. 12A, 12B, 12C, and 12D illustrate operations of the agitating balls in the embodiment.
Figure 12B:
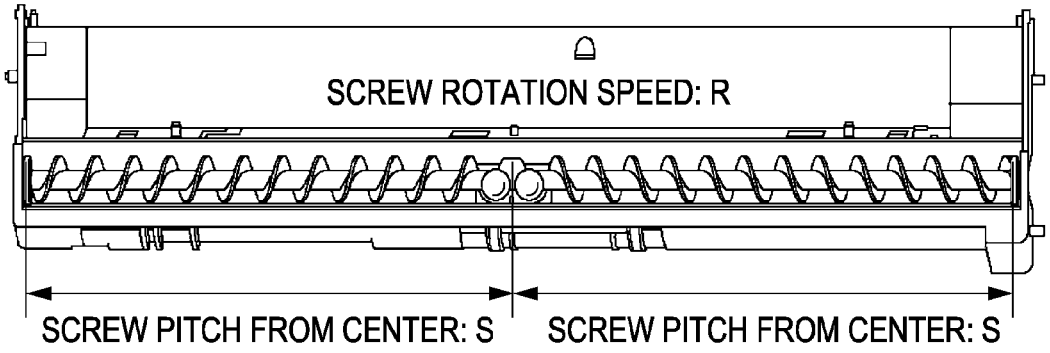
Figure 12C:
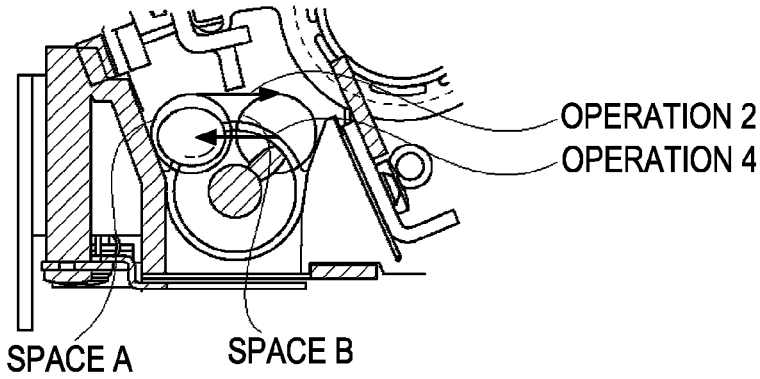
Figure 12D:
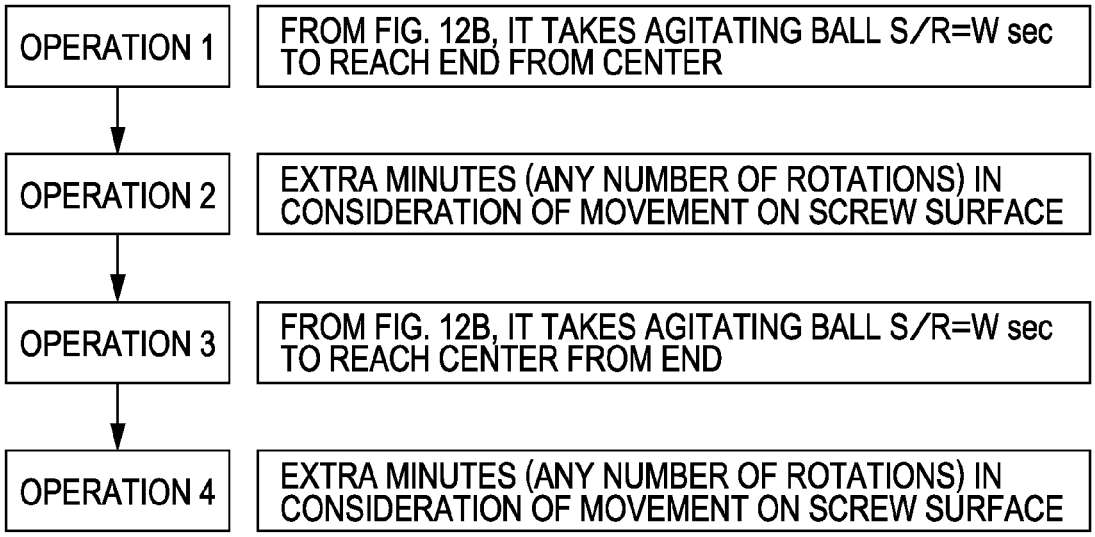

The operation sequence of the above configuration will be described with reference to FIGS. 12A, 12B, 12C, and 12D. The length of time to perform Operation 1 (see FIG. 12A), that is, the time it takes for the agitating balls to reach each end from the center is S/R (sec), where S is a screw pitch from the center to each end and R (rps) is a rotation speed of the screw as shown in FIG. 12B. Operation 2 (see FIG. 12A) is movement from Space A to Space B shown in FIG. 12C. The movement time is set to at least one rotation of the screw. Therefore, the necessary continuous rotation time of the screw in the CCW direction is the sum of S/R and the time the screw takes to make several rotations. During Operation 3 (see FIG. 12A), the screw is rotated in the direction opposite to that during Operation 1. The time the agitating balls take to reach the center from each end is also S/R (sec). Operation 4 (see FIG. 12A) is movement from Space B to Space A shown in FIG. 12C. The movement time is set to at least one rotation of the screw. By performing Operations 1, 2, 3, and 4 in this order, the agitating balls move throughout the screw, and the recovered toner can be prevented from being deposited in Space A and Space B over the screw and from being attached to the surface of the screw (see the operation sequence diagram of FIG. 12D). In this embodiment, the above movements are performed when image formation is not performed, for example, during pre-multi-rotation (rotation operation that is performed until image formation can be performed), pre-rotation, or post-rotation. The operations may be performed for every image formation operation or for every predetermined number of image formation operations.

In the above embodiment, the operation sequence is designed to cause the agitating balls to operate in both Space A and Space B (Mode 1). The cleaning device may have other modes in which the operation sequence of the agitating balls is different from that of Mode 1. For example, when one wants the agitating balls to operate only in Space A (Mode 2), operations are performed in the order of Operation 1, 3, 1, 3, 1, 3 . . . Since the agitating balls do not perform Operation 2 (do not move to Space B), the agitating balls operate only in Space A. In this case, it is necessary for the continuous rotation time of the screw in the CCW direction to be shorter than S/R. When one wants the agitating balls to operate only in Space B (Mode 3), operations are performed in the order of Operation 1, 2, 3, 1, 3, 1, 3, 1 . . . Since the agitating balls do not perform Operation 4 (do not move to Space A), the agitating balls operate only in Space B. When one wants the agitating balls to repeatedly operate in Space A and Space B (Mode 1), operations are performed in the order of Operation 1, 2, 3, 4, 1, 2, 3, 4 . . . These operation sequences can be performed at any time, for example, when the image forming apparatus is powered on, for every predetermined number of sheets, for every predetermined image density, or during maintenance. Modes 1 to 3 may be displayed on an operation panel so that the operator can select from them.

In the above configurations and operation sequences, which do not require a special mechanism for causing the agitating balls to operate throughout the screw, the timing and length of time of forward and reverse rotations of the screw are changed. As a result, the agitating balls can be disposed in intended places of the screw through intended paths, at the intended time, and deposition and attachment of the recovered toner can be prevented throughout the screw.

Although the present invention is applied to the cleaning device for the intermediate transfer member in this embodiment, the present invention can also be applied to the cleaning devices that clean the photosensitive drums. The present invention can also be applied to a screw that merges toner from the cleaning device for the intermediate transfer member and toner from the cleaning devices for the photosensitive drums and that conveys toner to the recovered-toner container. As described above, the present invention can prevent toner from being widely deposited on the conveying screw that conveys recovered toner.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2007-024431 filed Feb. 2, 2007, which is hereby incorporated by reference herein in its entirety.

What is claimed is:

1. A cleaning device comprising:

a cleaning unit configured to remove toner on an image bearing member;

a container adapted to contain therein the removed toner that is recovered;

a screw configured to convey the removed toner toward the container;

a spherical moving member configured to be moved by a rotation of the screw, wherein the spherical moving member is supported by an upper part of the screw; and a driving unit configured to rotate the screw in a first direction for conveying toner toward the container and in a second direction opposite to the first direction for conveying the spherical moving member.

2. The cleaning device according to claim 1, further comprising a second screw configured to convey the removed toner toward the container in a direction opposite to the direction in which the first screw conveys the removed toner toward the container, and a second spherical moving member configured to be moved by a rotation of the second screw.

3. The cleaning device according to claim 2, further comprising a protrusion located at a junction between the first and second screws and configured to prevent the first spherical moving member from moving to the second screw and the second spherical moving member from moving to the first screw.

4. The cleaning device according to claim 1, further comprising a regulation member, including a first region where the spherical moving member is moved by the rotation of the screw and a second region, different from the first region in relation to a direction of the rotation of the screw, where the spherical moving member is moved by the rotation of the screw, disposed opposed to the upper part of the screw, for regulate the spherical moving member from moving between the first region and the second region.

5. The cleaning device according to claim 1, wherein the spherical moving member is movable between a first region and a second region at an end portion in a direction of a rotation axis of the screw.

* * * * *